US006420284B1

(12) United States Patent
Myers et al.

(10) Patent No.: US 6,420,284 B1
(45) Date of Patent: Jul. 16, 2002

(54) POLY (VINYL ALCOHOL) WIPES

(75) Inventors: Ashley D. Myers, Norcross; Baosheng Lee, Duluth; Scott Blaine Burdette, Alpharetta, all of GA (US)

(73) Assignee: Isolyser Company, Inc., Norcross, GA (US)

( * ) Notice: Subject to any disclaimer, the term of this patent is extended or adjusted under 35 U.S.C. 154(b) by 0 days.

(21) Appl. No.: 09/291,133

(22) Filed: Apr. 12, 1999

Related U.S. Application Data

(63) Continuation-in-part of application No. 09/280,791, filed on Mar. 26, 1999, now Pat. No. 6,107,390.

(51) Int. Cl.[7] ..... B32B 27/02; B32B 5/02

(52) U.S. Cl. ..... 442/166; 442/164; 442/123; 428/320.2; 428/305.5; 15/209.1; 15/104.93; 401/132

(58) Field of Search ..... 442/164, 166, 442/123; 428/320.2, 305.5; 15/209.1, 104.93; 401/132

(56) References Cited

U.S. PATENT DOCUMENTS

| | | | | |
|---|---|---|---|---|
| 3,881,210 A | * | 5/1975 | Drach et al. | 15/104.93 |
| 4,164,595 A | | 8/1979 | Adams et al. | |
| 4,570,311 A | | 2/1986 | Kawamura et al. | |
| 4,731,277 A | | 3/1988 | Goritzsch et al. | |
| 5,455,114 A | | 10/1995 | Ohmory et al. | |
| 5,486,418 A | | 1/1996 | Ohmory et al. | |
| 5,500,068 A | | 3/1996 | Srinivasan et al. | |
| 5,547,601 A | | 8/1996 | Volpe | |
| 5,707,731 A | | 1/1998 | Honeycutt et al. | |
| 5,765,717 A | | 6/1998 | Gottselig | |
| 5,861,213 A | | 1/1999 | Ohmory et al. | |
| 6,110,293 A | * | 8/2000 | Honeycutt et al. | 134/6 |

FOREIGN PATENT DOCUMENTS

| | | |
|---|---|---|
| DE | 196 20 503 A1 | 11/1997 |
| EP | 0 491 383 A1 | 6/1992 |
| EP | 0 590 307 B1 | 4/1994 |
| EP | 08311757 | 11/1996 |
| FR | 1 555 705 | 1/1969 |
| GB | 1060102 | 5/1967 |
| GB | 2 065 139 A | 6/1981 |
| GB | 2 222 526 A | 3/1990 |
| JP | 06071815 | 3/1994 |
| WO | WO 98/10126 | 3/1998 |
| WO | WO 99/41024 | 8/1999 |

* cited by examiner

*Primary Examiner*—Terrel Morris
*Assistant Examiner*—Arti R. Singh
(74) *Attorney, Agent, or Firm*—Needle & Rosenberg, P.C.

(57) ABSTRACT

A fabric comprising poly(vinyl alcohol) fibers, and a solvent, wherein the fabric is at least partially saturated with the solvent; a kit comprising a container, and a plurality of adjacent sheets disposed within the container, wherein the sheets comprise the fabric; a kit comprising a container; and a roll of the fabric disposed within the container; wherein the fabric comprises a width and a length, the lengthlwidth ratio is greater than 10:1, a series of perforations traverse the width of the fabric at evenly spaced intervals; and a method of using the fabric comprising contacting the fabric with the residue of a chemical or mechanical process.

24 Claims, No Drawings

POLY (VINYL ALCOHOL) WIPES

This application is a continuation in part of an earlier application Ser. No. 09/280,791, filed Mar. 26, 1999, now U.S. Pat. No. 6,107,390.

FIELD OF THE INVENTION

The present invention relates to fabrics made from poly (vinyl alcohol) fibers, that are at least partially saturated with a solvent, and useful as wipes.

BACKGROUND OF THE INVENTION

Wipes are used for many purposes in a variety of applications. When saturated with solvents, wipes provide a convenient method of cleaning surfaces. However, wipes of the prior art suffer from a number of drawbacks. For example, many fabrics used for wipes are not sufficiently absorbent, and do not hold or distribute the solvent very well. Many materials used for the fabrics are not very resistant to acids and bases, or degrade when stored for intermediate periods of time. Other fabrics, such as cellulose-based fabrics, are not very strong, and fall apart when contacted with solvent. Thus, there is a need for a wipe with improved absorbency, shelf life, chemical resistance, and strength.

SUMMARY OF THE INVENTION

It has been discovered that wipes constructed of poly (vinyl alcohol) give improved absorbency, shelf life, chemical resistance, and strength over wipes of the prior art. Thus, in one aspect the invention provides a fabric comprising poly(vinyl alcohol) fibers, and a solvent, wherein the fabric is at least partially saturated with the solvent.

In another aspect the invention provides a kit comprising a container, and a plurality of adjacent sheets disposed within the container, wherein the sheets comprise the fabric.

In another aspect the invention provides a kit comprising a container; and a roll of the fabric disposed within the container; wherein the fabric comprises a width and a length, the length/width ratio is greater than 10:1, a series of perforations traverse the width of the fabric at evenly spaced intervals.

In still another aspect the invention provides a method of using the fabric comprising contacting the fabric with the residue of a chemical process or mechanical process.

Additional aspects and advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DISCUSSION OF THE INVENTION

The present invention may be understood more readily by reference to the following detailed description of preferred embodiments of the invention and the Examples included therein.

Before the present materials and methods are disclosed and described, it is to be understood that this invention is not limited to specific methods or materials as such may, of course, vary. It is also to be understood that the terminology used herein is for the purpose of describing particular embodiments only and is not intended to be limiting.

Use of Terms

As used in the specification and the appended claims, the singular forms "a," "an" and "the" include plural referents unless the context clearly dictates otherwise. Thus, for example, reference to "a fiber" includes mixtures of fibers.

Ranges are often expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. Similarly, when ranges extend from one endpoint to another endpoint, another embodiment includes the range between the endpoints and excluding the endpoints.

References in the specification and concluding claims to parts by weight, of a particular element or component in a composition or article, denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent of a component, unless specifically stated to the contrary, is based on the total weight of the formulation, composition, or material in which the component is included.

A residue of a chemical process, as used in the specification and concluding claims, refers to the resulting product or by-product of a particular reaction scheme or chemical process. A residue of a mechanical process refers to the by-product or waste generated during the mechanical process, such as grease, grime, or particulate matter.

By the term "effective amount" of a compound or property as provided herein is meant such amount as is capable of performing the function of the compound or property for which an effective amount is expressed. As will be pointed out below, the exact amount required will vary from process to process, depending on recognized variables such as the compounds employed and the processing conditions observed. Thus, it is not always possible to specify an exact "effective amount." However, an appropriate effective amount may be determined by one of ordinary skill in the art using only routine experimentation.

Degree of hydrolysis also includes degree of saponification where saponification is employed in the preparation of poly(vinyl alcohol).

Solvent means any liquid which is suitable for use in a wipe, and includes pure liquids, mixtures of liquids, and solutions that contain dissolved ingredients such as softeners and cleaning agents.

DESCRIPTION OF THE INVENTION

In one aspect the invention provides a fabric comprising poly(vinyl alcohol) fibers, and a solvent, wherein the fabric is at least partially saturated with the solvent.

In another aspect the invention provides a kit comprising a container, and a plurality of adjacent sheets disposed within the container, wherein the sheets comprise the fabric.

In another aspect the invention provides a kit comprising a container; and a roll of the fabric disposed within the container; wherein the fabric comprises a width and a length, the length/width ratio is greater than 10:1, a series of perforations traverse the width of the fabric at evenly spaced intervals.

In still another aspect the invention provides a method of using the fabric comprising contacting the fabric with the residue of a chemical or mechanical process.

The invention is preferably practiced with poly(vinyl alcohol) fibers meeting the following characteristics:

1. Degree of polymerization of poly(vinyl alcohol): Preferably from about 300 to about 5000, more preferably from about 800 to about 3000, and still more preferably from about 1200 to about 2000.
2. Degree of hydrolysis of poly(vinyl alcohol): Preferably greater than 95%, more preferably greater than 97%, even more preferably greater than 98%, even further preferably greater than 99%. In a separate embodiment, when the solvent is not water, the degree of hydrolysis can be as low as 80% and below 85%, 90%, or 95%.
3. Average denier of fibers: Preferably from about 0.1 to about 10, more preferably from about 0.5 and about 5, and even more preferably from about 1 to about 3 denier.
4. Average length of fibers: Preferably from about 4 mm to about 300 mm, more preferably from about 5 to about 100 mm, even more preferably from about 15 to about 60 mm, and most preferably from about 38 mm. The foregoing lengths are preferred when using staple fibers to form nonwoven fabrics. In another embodiment the fibers are continuous filaments. Continuous filaments are especially useful to form woven or knitted fabrics. Continuous filaments are preferably less than about 3 deniers.
5. Temperature above which the fiber is soluble in water, and below which the fiber is insoluble in water, in separate embodiments: 20° C., 30° C., 40° C., 50° C., 60° C., 70° C., 80° C., 90° C., 100° C., and 110° C.

The fabric can be made by a number of potential processes, including pressure liquid entangling (i.e. hydroentangling using any suitable liquid). Thus, in one embodiment the fabric is produced by a method comprising the consecutive steps of supporting a plurality of poly(vinyl alcohol) fibers on a mesh screen to form a web; pressure liquid-entangling the web; and drying the web.

The pressure liquid entangling can be performed under any conditions that does not materially affect the desired properties of the web. For hot water soluble poly(vinyl alcohol) the liquid entangling is preferably performed with water.

The pressure liquid entangling is preferably performed at a water pressure of from about 10 to about 200 bar, more preferably at a water pressure of from about 20 to about 120 bar, and even more preferably at a water pressure of from about 40 to about 100 bar. The drying is preferably performed at a temperature of from about 20° C. to about 190° C., and in an alternative embodiment at a temperature that exceeds the solubility temperature of the poly(vinyl alcohol) in water. The drying is preferably performed by passing heated air through the web. Even more preferably, the web is dried by passing it over a perforated wheel that draws air through the fabric and into the perforated wheel.

The pressure liquid entangling method might also preferably comprise other steps, including, after the first step, the steps of cross-lapping the web; and stretching the web in the machine direction. The method might also comprise, after the drying step, winding the web onto a roll.

Other methods to produce the fabrics of the present invention include heat fusion (which includes thermobonding), chemical bonding, needlepunching, stitchbonding, weaving, and knitting.

The fabric preferably satisfies the following criteria:

1. Thickness: Preferably from about 0.1 mm to about 5 mm, more preferably from about from about 0.3 mm to about 0.6 mm, and most preferably about 0.4 mm.
2. Base weight: Preferably from about 20 g/m$^2$ to about 400 g/m$^2$, more preferably from about 35 to about 200 g/m$^2$, even more preferably from about 50 to about 100 g/m$^2$, still even more preferably from about 60 to about 80 g/m$^2$, and most preferably about 70 g/m$^2$. In an alternative embodiment the preferred base weight is from about 100 to about 200 g/m$^2$, still even more preferably from about 140 to about 160 g/m$^2$, and most preferably about 150 g/m$^2$.

The poly(vinyl alcohol) fabric may also include other fibers selected from the group consisting of polyester, polypropylene, polyethylene, rayon, cellulose, nylon, ethylene/(meth)acrylic acid copolymer, and other fibrous polymers known in the art.

A number of liquids can be used for the solvent, including without limitation water, methyl ethyl ketone, methyl propyl ketone, acetone, isopropyl alcohol, and mixtures thereof. In preferred embodiments the solvent comprises a mixture of water and isopropyl alcohol or a mixture of methyl ethyl ketone and methyl propyl ketone.

In one particular embodiment the solvent comprises from about 35 to about 95 weight parts methyl ethyl ketone, and from about 5 to about 65 weight parts methyl propyl ketone, preferably from about 55 to about 75 weight parts methyl ethyl ketone, and from about 25 to about 45 weight parts methyl propyl ketone. In another particular embodiment the solvent comprises from about 50 to about 98 weight parts isopropyl alcohol, and from about 2 to about 50 weight parts water, preferably from about 75 to about 95 weight parts isopropyl alcohol, and from about 5 to about 25 weight parts water. In still another embodiment the solvent comprises about 1 to about 10 weight parts isopropyl alcohol, and from about 99 to about 90 weight parts water.

An advantageous feature of this wipes of this invention is their ability to absorb, retain, and distribute liquids. Thus, in separate embodiments, the web is capable of absorbing greater than 5, 5.5, 6, 6.5, 7, 7.5, and 8 weight parts solvent per weight part web. When the solvent is water, the web is capable of absorbing greater than 5, 5.5, 6, 6.5, 7, 7.5, and 8 weight parts solvent per weight part web. When the solvent is a mixture of isopropyl alcohol and water, the web is capable of absorbing greater than 5, 5.5, 6, 6.5, 7, 7.5, and 8 weight parts solvent per weight part web. When the solvent is a mixture of methyl ethyl ketone and methyl propyl ketone, the web is capable of absorbing greater than 2.5, 3, 3.5, 4, 4.5, and 5 weight parts solvent per weight part web.

Thus, the web can be saturated with solvent to varying degrees, including, in separate embodiments, greater than 20, 30, 40, 50, 60, 70, 80, and 90 wt.% of maximum absorption. The fabric preferably comprises greater than about 2, 3, 4, 5, 6, 7, or 8 weight parts solvent per weight part web, and/or less than 9, 8, 7, 6, or 5 weight parts solvent per weight part web.

In one embodiment the fabric is configured into a sheet having a width and a length, neither of which is greater than 50 centimeters. In another embodiment the width and length do not exceed 30 centimeters. In still another embodiment the length/width ratio is greater than 10:1, and the fabric is configured into a roll.

An important attribute of the fabrics made by the process of this invention is their superior physical properties. Thus, the fabric preferably satisfies one or more of the following properties, and can satisfy any combination of the following properties.

1. Tensile Strength: The fabric preferably has a tensile strength in the machine direction greater than about 10, 15, or 20 pounds, and/or a tensile strength in the cross direction greater than about 10, 15, or 20 pounds when measured for a one inch strip according to ASTM D5035-95.
2. Bursting Strength: The fabric preferably has a bursting strength greater than 6, 8, or 10 psi when measured by ASTM D3776-96.

Still another advantageous feature of the fabrics of the present invention is their stability in the presence of acids and bases. For example, the fabrics are preferably stable against 50% sodium hydroxide solutions, and 20% sulfuric acid solutions. Thus, the acids and bases can be used as the solvents in the present invention, or the fabrics can be used to wipe acids and bases.

The following examples are put forth so as to provide those of ordinary skill in the art with a complete disclosure and description of how the materials claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at room temperature, and pressure is at or near atmospheric.

EXAMPLE 1

Retention/Distribution

This test was meant to measure the difference in absorption and retention of fluids in a stack of samples in a closed container. The test was conducted by preparing a stack of 21 samples of material, each measuring 8'×8", and weighing selected samples through the stack. For these tests, sample numbers 1,5,9,13,17, & 21 were the measured samples. Samples were identified by marking the top sample as #1, and counting down through the stack to the bottom sample, numbered #21. The samples were then placed in a one gallon zip-lock bag, and 450 mL of test fluid was added and the bags were sealed. The bags were allowed to set over night (~24 hours), then were opened and the marked samples immediately re-weighed as they come off the stack. The samples and bag should be disturbed as little as possible from a flat lying position. The pre-weights and post-weights were compared to calculate the pick-up for each test sample. The deviation and range of the pick-up is used as a measure of the retention and distribution characteristics for the sample stack.

Sontara EC wipes and Kimtex wipes samples were purchased off the shelf, and are produced by DuPont and Kimberly Clark respectively. OREX thermobond and OREX spunlaced are poly(vinyl alcohol) fabrics of the current invention, and were produced respectively by heat fusion and hydroentangling processes.

| | | $H_2O$ | | | IPA/$H_2O$* | | | Solvent Mix** | | |
|---|---|---|---|---|---|---|---|---|---|---|
| Sample | | Prewt | Postwt | Pick-up | Prewt | Postwt | Pick-up | Prewt | Postwt | Pick-up |
| Sontara | 1. | 3.2 | 20.2 | 17.0 | 3.1 | 19.9 | 16.8 | 3.2 | 13.8 | 10.6 |
| | 2. | 3.3 | 20.8 | 17.5 | 3.1 | 20.6 | 17.5 | 3.3 | 15.0 | 11.7 |
| | 3. | 3.2 | 20.5 | 17.3 | 3.2 | 21.6 | 18.4 | 3.1 | 15.7 | 12.6 |
| | 4. | 3.2 | 21.8 | 18.6 | 3.2 | 22.7 | 19.5 | 3.4 | 17.5 | 14.1 |
| | 5. | 3.3 | 23.8 | 20.5 | 3.4 | 25.4 | 22.0 | 3.1 | 15.5 | 12.4 |
| | 6. | 3.3 | 28.2 | 24.9 | 3.2 | 28.9 | 25.7 | 3.2 | 17.6 | 14.4 |
| Avg. | | 3.3 | 22.6 | 19.3 | 3.2 | 23.2 | 20.0 | 3.2 | 15.9 | 12.6 |
| Std. Dev. | | 0.1 | 3.1 | 3.0 | 0.1 | 3.4 | 3.3 | 0.1 | 1.5 | 1.4 |
| Range | | | | 7.9 | | | 8.9 | | | 3.8 |
| Kimtex | 1. | 2.9 | 16.4 | 13.5 | 2.7 | 17.2 | 14.5 | 2.7 | 17.1 | 14.4 |
| | 2. | 2.9 | 16.9 | 14.0 | 2.9 | 20.6 | 17.7 | 2.6 | 16.3 | 13.7 |
| | 3. | 2.9 | 16.6 | 13.7 | 2.7 | 22.1 | 19.4 | 2.7 | 17.6 | 14.9 |
| | 4. | 2.9 | 17.7 | 14.8 | 2.8 | 23.6 | 20.8 | 2.7 | 17.7 | 15.0 |
| | 5. | 2.8 | 19.2 | 16.4 | 2.9 | 24.0 | 21.1 | 2.6 | 19.5 | 16.9 |
| | 6. | 2.6 | 22.7 | 20.1 | 2.8 | 26.2 | 23.4 | 2.7 | 20.4 | 17.7 |
| Avg. | | 2.8 | 18.3 | 15.4 | 2.8 | 22.3 | 19.5 | 2.7 | 18.1 | 15.4 |
| Std. Dev. | | 0.1 | 2.4 | 2.5 | 0.1 | 3.1 | 3.1 | 0.1 | 1.5 | 1.5 |
| Range | | | | 6.6 | | | 8.9 | | | 4.0 |
| OREX | 1 | 2.5 | 19.3 | 16.8 | 2.7 | 20.1 | 17.4 | 2.6 | 13.8 | 11.2 |
| thermobond | 2 | 2.5 | 19.7 | 17.2 | 2.9 | 20.0 | 17.1 | 2.5 | 12.5 | 10.0 |
| | 3 | 3.0 | 21.3 | 18.3 | 2.8 | 20.0 | 17.2 | 3.3 | 13.7 | 10.4 |
| | 4 | 3.0 | 22.8 | 19.8 | 3.3 | 22.7 | 19.4 | 3.1 | 14.3 | 11.2 |
| | 5 | 2.2 | 22.4 | 20.2 | 3.1 | 23.0 | 19.9 | 2.7 | 14.6 | 11.9 |
| | 6 | 2.2 | 24.3 | 22.1 | 2.8 | 29.0 | 26.2 | 2.6 | 15.3 | 12.7 |
| Avg. | | 2.6 | 21.6 | 19.1 | 2.9 | 22.5 | 19.5 | 2.8 | 14.0 | 11.2 |
| Std. Dev. | | 0.4 | 1.9 | 2.0 | 0.2 | 3.5 | 3.5 | 0.3 | 1.0 | 1.0 |
| Range | | | | 5.3 | | | 8.8 | | | 2.7 |
| OREX | 1. | 2.2 | 19.6 | 17.4 | 2.0 | 19.6 | 17.6 | 2.0 | 16.7 | 14.7 |
| spunlace | 2. | 1.9 | 20.1 | 18.2 | 1.9 | 19.3 | 17.4 | 1.8 | 16.2 | 14.4 |
| | 3. | 2.1 | 21.8 | 19.7 | 2.0 | 21.3 | 19.3 | 2.3 | 16.5 | 14.2 |
| | 4. | 2.2 | 23.7 | 21.5 | 2.0 | 22.1 | 20.1 | 2.3 | 17.8 | 15.5 |
| | 5. | 1.8 | 23.5 | 21.7 | 1.9 | 22.7 | 20.8 | 1.9 | 17.2 | 15.3 |
| | 6. | 2.1 | 24.2 | 22.1 | 2.0 | 25.3 | 23.3 | 2.3 | 19.9 | 17.6 |
| Avg. | | 2.1 | 22.2 | 20.1 | 2.0 | 21.7 | 19.8 | 2.1 | 17.4 | 15.3 |
| Std. Dev. | | 0.2 | 2.0 | 2.0 | 0.1 | 2.2 | 2.2 | 0.2 | 1.4 | 1.2 |
| Range | | | | 4.7 | | | 5.9 | | | 3.2 |

EXAMPLE 2

Total Absorbency

Samples measuring 8"×8" were cut for each material (6 each), and weighed. Each sample set was then completely submersed in test fluid for 5 minutes, lying flat. After this time, the samples were removed individually and held by one corner and allowed to drip excess fluid off the surface for 10 seconds. The sample was then immediately placed on the scale and reweighed. The pre-weight and post-weight of each sample was then compared to calculate the total absorbency of the sample, expressed as the % weight of the sample in fluid picked up.

| Sample | # | $H_2O$ | IPA/$H_2O$ | Solvent Mix |
|---|---|---|---|---|
| Sontara | 1. | 5.3 | 4.9 | 5.9 |
| | 2. | 5.4 | 4.8 | 5.9 |
| | 3. | 5.2 | 4.7 | 5.9 |
| | Avg. | 5.3 | 4.8 | 5.9 |
| Kimtex | 1. | 4.0 | 3.9 | 4.0 |
| | 2. | 4.2 | 4.0 | 4.5 |
| | 3. | 4.1 | 4.2 | 3.9 |
| | Avg. | 4.1 | 4.0 | 4.1 |

| | | $H_2O$ | | | IPA/$H_2O$* | | | Solvent Mix** | | |
|---|---|---|---|---|---|---|---|---|---|---|
| Sample | | Prewt. | Postwt. | % Abs. | Prewt. | Postwt. | % Abs. | Prewt. | Postwt. | % Abs. |
| Sontara | 1. | 3.3 | 19.8 | 498.5 | 3.3 | 19.5 | 490.9 | 3.3 | 11.0 | 233.3 |
| | 2. | 3.2 | 20.1 | 527.8 | 3.3 | 19.2 | 481.8 | 3.3 | 11.8 | 257.6 |
| | 3. | 3.1 | 20.3 | 554.8 | 3.3 | 19.2 | 481.8 | 3.2 | 11.5 | 259.4 |
| | 4. | 3.2 | 19.5 | 510.6 | 3.3 | 19.6 | 493.9 | 3.2 | 11.3 | 253.1 |
| | 5. | 3.2 | 20.3 | 533.1 | 3.0 | 18.9 | 530.0 | 3.3 | 11.6 | 251.5 |
| | 6. | 3.2 | 20.1 | 526.6 | 3.3 | 20.1 | 509.1 | 3.3 | 11.7 | 254.5 |
| Avg. | | 3.2 | 20.0 | 525.2 | 3.3 | 19.4 | 497.9 | 3.3 | 11.5 | 251.6 |
| Std. Dev. | | 0.1 | 0.3 | 19.4 | 0.1 | 0.4 | 18.6 | 0.1 | 0.3 | 9.4 |
| Kimtex | 1. | 2.9 | 16.9 | 482.1 | 3.1 | 19.1 | 516.1 | 3.1 | 14.8 | 377.4 |
| | 2. | 2.7 | 19.1 | 607.8 | 3.0 | 18.3 | 510.0 | 2.9 | 14.9 | 413.8 |
| | 3. | 2.6 | 18.1 | 596.2 | 2.9 | 17.9 | 517.2 | 2.7 | 15.2 | 463.0 |
| | 4. | 2.7 | 18.3 | 578.9 | 2.9 | 18.2 | 527.6 | 2.8 | 13.8 | 392.9 |
| | 5. | 2.6 | 18.7 | 619.6 | 2.9 | 17.7 | 510.3 | 2.6 | 15.0 | 476.9 |
| | 6. | 2.7 | 18.9 | 598.1 | 2.7 | 19.4 | 618.5 | 2.8 | 14.5 | 417.9 |
| Avg. | | 2.7 | 18.3 | 580.4 | 2.9 | 18.4 | 533.3 | 2.8 | 14.7 | 423.6 |
| Std. Dev. | | 0.1 | 0.8 | 50.0 | 0.1 | 0.7 | 42.2 | 0.2 | 0.5 | 39.0 |
| OREX | 1. | 2.5 | 18.3 | 631.6 | 2.5 | 18.4 | 636.0 | 2.5 | 10.0 | 300.0 |
| thermobond | 2. | 2.6 | 19.5 | 648.1 | 2.6 | 18.0 | 592.3 | 2.6 | 10.7 | 311.5 |
| | 3. | 2.3 | 17.3 | 653.9 | 2.4 | 18.0 | 650.0 | 2.5 | 10.5 | 320.0 |
| | 4. | 2.4 | 17.0 | 607.9 | 2.6 | 19.1 | 634.6 | 2.6 | 10.8 | 315.4 |
| | 5. | 2.2 | 16.6 | 655.0 | 2.6 | 18.0 | 592.3 | 2.7 | 10.6 | 292.6 |
| | 6. | 2.2 | 16.5 | 649.5 | 2.4 | 17.8 | 641.7 | 2.5 | 10.1 | 304.0 |
| Avg. | | 2.4 | 17.5 | 641.0 | 2.5 | 18.2 | 624.5 | 2.6 | 10.5 | 307.3 |
| Std. Dev. | | 0.2 | 1.1 | 18.3 | 0.1 | 0.5 | 25.5 | 0.1 | 0.3 | 10.2 |
| OREX | 1. | 2.0 | 18.3 | 816.0 | 2.1 | 18.4 | 776.2 | 2.3 | 14.0 | 508.7 |
| spunlace | 2. | 2.3 | 19.8 | 760.0 | 2.4 | 19.4 | 708.3 | 1.9 | 11.8 | 521.1 |
| | 3. | 1.9 | 18.0 | 846.8 | 1.7 | 17.3 | 917.6 | 2.3 | 13.8 | 500.0 |
| | 4. | 2.2 | 19.5 | 785.9 | 2.3 | 19.1 | 730.4 | 2.1 | 13.2 | 528.6 |
| | 5. | 2.1 | 18.7 | 789.0 | 2.1 | 18.5 | 781.0 | 2.0 | 12.7 | 535.0 |
| | 6. | 1.9 | 17.4 | 817.4 | 1.9 | 17.3 | 810.5 | 2.2 | 13.0 | 490.9 |
| Avg. | | 2.1 | 18.6 | 802.5 | 2.1 | 18.3 | 787.3 | 2.1 | 13.1 | 514.0 |
| Std. Dev. | | 0.2 | 0.9 | 30.4 | 0.3 | 0.9 | 73.7 | 0.2 | 0.8 | 17.1 |

*IPA (15%):Water (85%)
** MEK (65%):MPK (35%)

EXAMPLE 3

Wicking

This is a simple test to measure the speed of wicking on a flat, horizontal plane for each test material. A sample of each material measuring 8"×8" was placed flat on the resin bench top, and marked with a lab marker by placing a small dot at the center of the wipe. A 1 mL micro pipette was used to measure and apply exactly 1 mL of test fluid to the sample at the sight of the dot. As soon as the test fluid touches the sample, a timer is started and 60 seconds is allowed to elapse. At the end of the 60 seconds the distance from the dot to the farthermost edge of the wicking circle is measured with a ruler (in centimeters). A small amount of food coloring may be added to the test fluid prior to application to help clarify the wicking circle.

-continued

| Sample | # | $H_2O$ | IPA/$H_2O$ | Solvent Mix |
|---|---|---|---|---|
| OREX thermobond | 1. | 5.1 | 5.1 | 5.1 |
| | 2. | 5.0 | 5.5 | 5.1 |
| | 3. | 5.1 | 5.1 | 5.1 |
| | Avg. | 5.1 | 5.2 | 5.1 |
| OREX spunlace | 1. | 5.1 | 4.6 | 4.9 |
| | 2. | 5.0 | 4.9 | 4.2 |
| | 3. | 5.0 | 4.6 | 4.5 |
| | Avg. | 5.0 | 4.7 | 4.5 |

EXAMPLE 4

Initial Absorbency

This example tests initial absorbency and wicking of fabric samples. The method uses a predetermined set time and volume of fluid and measures the amount of fluid pick-up, in terms of percent weight of the sample, that is achieved within the set time. The percent of total volume of fluid can also be calculated for comparison.

The method uses a standard IPR (Impact Penetration Resistance) apparatus, as described in AATCC method 42-1994. The apparatus is set up with a distance of 8.5 inches from the head to the point of impact. A standard volume of 250 mL of test fluid is used, over a standard time of 30 seconds. Also needed is a scale for measuring the sample weights, and a stop watch to time each test. All test samples should be of a (same) standardized size, which fits completely on the sample clip board with no over-hang. If folding of the sample is required to fit the sample on the clip board, the same number and size folds should be used for all samples.

The sample clip board is placed on the scale, and the scale tared. The test sample is then placed on the clip board and its preweight (S) recorded. The scale is again tared, and the clip board/sample placed onto the testing apparatus. The test fluid is then poured into the head funnel, and the stop watch simultaneously started. After the time has elapsed, the clip board/sample is removed from the apparatus and placed back on the scale, and the amount of water absorbed (W) is recorded.

% absorbency by weight of sample=(W/S)*100

| Sample | # | Prewt. | Water Abs. | % Abs. |
|---|---|---|---|---|
| Sontara | 1. | 3.3 | 11.2 | 339.4 |
| | 2. | 3.4 | 12.6 | 370.6 |
| | 3. | 3.3 | 12.2 | 369.7 |
| | 4. | 3.1 | 12.8 | 412.9 |
| | 5. | 3.4 | 11.2 | 329.4 |
| | Avg. | 3.3 | 12.0 | 364.4 |
| | Std. Dev. | 0.1 | 0.7 | 29.2 |
| Kimtex | 1. | 2.8 | 8.3 | 296.4 |
| | 2. | 2.8 | 9.7 | 346.4 |
| | 3. | 2.7 | 9.7 | 359.3 |
| | 4. | 2.7 | 8.3 | 307.4 |
| | 5. | 2.6 | 9.0 | 346.2 |
| | Avg. | 2.7 | 9.0 | 331.1 |
| | Std. Dev. | 0.1 | 0.6 | 24.6 |
| OREX thermobond | 1. | 2.8 | 7.6 | 271.4 |
| | 2. | 2.6 | 7.7 | 296.2 |
| | 3. | 2.5 | 7.4 | 296.0 |
| | 4. | 2.4 | 7.1 | 295.8 |
| | 5. | 2.8 | 7.6 | 271.4 |
| | Avg. | 2.6 | 7.5 | 286.2 |
| | Std. Dev. | 0.2 | 0.2 | 12.0 |
| OREX spunlace | 1. | 2.2 | 16.2 | 736.4 |
| | 2. | 2.0 | 13.5 | 675.0 |
| | 3. | 2.1 | 14.0 | 666.7 |
| | 4. | 1.9 | 14.3 | 752.6 |
| | 5. | 1.8 | 14.2 | 788.9 |
| | Avg. | 2.0 | 14.4 | 723.9 |
| | Std. Dev. | 0.1 | 0.9 | 46.6 |

Throughout this application, various publications are referenced. The disclosures of these publications in their entireties are hereby incorporated by reference into this application in order to more fully describe the state of the art to which this invention pertains.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fabric comprising:

a) a plurality of polyvinyl alcohol fibers;

b) one or more fibers selected from the group consisting of polyester fibers, polypropylene fibers, polyethylene fibers, rayon fibers, cellulose fibers, nylon fibers, and ethylene/(meth)acrylic acid copolymer fibers; and c) a solvent, wherein at least a portion of the fibers of (a) and (b) are at least partially saturated with the solvent.

2. The fabric of claim 1 wherein the poly(vinyl alcohol) has a degree of polymerization of from about 300 to about 5000.

3. The fabric of claim 1 wherein the poly(vinyl alcohol) has a degree of polymerization of from about 1200 to about 2000.

4. The fabric of claim 1 wherein the poly(vinyl alcohol) has a degree of hydrolysis greater than 85%.

5. The fabric of claim 1 wherein the poly(vinyl alcohol) has a degree of hydrolysis greater than 98%.

6. The fabric of claim 1 wherein the poly(vinyl alcohol) fibers have an average denier of from about 0.1 to about 10.

7. The fabric of claim 1 wherein the fabric is woven, and the fibers are continuous filaments.

8. The fabric of claim 1 wherein the poly(vinyl alcohol) fibers have an average length of from about 15 mm to about 60 mm.

9. The fabric of claim 1 wherein the poly(vinyl alcohol) fibers are soluble in water above 75° C., and insoluble in water below 75° C.

10. The fabric of claim 1 wherein the poly(vinyl alcohol) fibers are soluble in water above 90° C., and insoluble in water below 90° C.

11. The fabric of claim 1 wherein the poly(vinyl alcohol) fibers are soluble in water above 90° C., and insoluble in water below 20° C.

12. The fabric of claim 1 produced by pressure liquid entanglement, heat fusion, chemical bonding, stitchbonding, weaving, knitting or needlepunching.

13. The fabric of claim 1 having a thickness of from about 0.3 mm to about 0.6 mm.

14. The fabric of claim 1 having a base weight of about 60 $g/m^2$ to about 80 $g/m^2$.

15. The fabric of claim 1 having a base weight of about 140 g/m to about 160 $g/m^2$.

16. The fabric of claim 1 having a tensile strength in the machine direction greater than 15 pounds, and a tensile strength in the cross direction greater than 15 pounds when measured for a one inch strip according to ASTM D5035-95.

17. The fabric of claim 1 having a bursting strength greater than 8 psi when measured by ASTM D3786-87.

18. The fabric of claim 1 wherein the solvent comprises water, methyl ethyl ketone, methyl propyl ketone, acetone, isopropyl alcohol, or a mixture thereof.

19. The fabric of claim 1 wherein the solvent comprises:

a. from about 35 to about 95 weight parts methyl ethyl ketone, and b. from about 5 to about 65 weight parts methyl propyl ketone.

20. The fabric of claim 1 wherein the solvent comprises water and isopropyl alcohol.

21. The fabric of claim 1 having a width and a length, neither of which is greater than 50 centimeters.

22. The fabric of claim 1 comprising a width and a length, wherein the length/width ratio is greater than 10:1, and the fabric is configured into a roll.

23. The fabric of claim 1 comprising a width and a length, wherein the length/width ratio is greater than 10:1, a series of perforations traverse the width of the fabric at evenly spaced intervals, and the fabric is configured into a roll.

24. A fabric comprising:

a) a plurality of polyvinyl alcohol fibers; and b) a solvent, wherein at least a portion of the polyvinyl alcohol fibers are at least partially saturated with the solvent and, wherein the solvent comprises (i) from about 35 to about 95 weight parts methyl ethyl ketone, and (ii) from about 5 to about 65 weight parts methyl propyl ketone.

* * * * *